US011171446B2

(12) United States Patent
Metzler

(10) Patent No.: US 11,171,446 B2
(45) Date of Patent: Nov. 9, 2021

(54) CONTACT FOR PLUG CONNECTOR

(71) Applicant: Andreas Metzler, Hohenems (AT)

(72) Inventor: Andreas Metzler, Hohenems (AT)

(73) Assignee: HIRSCHMANN AUTOMOTIVE GMBH, Rankweil/Brederis (AT)

( * ) Notice: Subject to any disclaimer, the term of this patent is extended or adjusted under 35 U.S.C. 154(b) by 28 days.

(21) Appl. No.: 16/485,622

(22) PCT Filed: Mar. 21, 2018

(86) PCT No.: PCT/EP2018/057155
§ 371 (c)(1),
(2) Date: Aug. 13, 2019

(87) PCT Pub. No.: WO2018/172406
PCT Pub. Date: Sep. 27, 2018

(65) Prior Publication Data

US 2019/0363487 A1 Nov. 28, 2019

(30) Foreign Application Priority Data

Mar. 22, 2017 (DE) ..... 102017106182.7

(51) Int. Cl.
*H01R 4/60* (2006.01)
*H01R 13/627* (2006.01)
*H01R 13/11* (2006.01)
*H01R 13/432* (2006.01)

(52) U.S. Cl.
CPC ..... *H01R 13/6272* (2013.01); *H01R 13/113* (2013.01); *H01R 13/114* (2013.01); *H01R 13/432* (2013.01)

(58) Field of Classification Search
CPC ..... H01R 13/6272; H01R 13/113; H01R 13/114; H01R 13/432; H01R 13/642; H01R 13/18; H01R 4/185; H01R 4/06
USPC ..... 439/282
See application file for complete search history.

(56) References Cited

U.S. PATENT DOCUMENTS 5,338,229 A * 8/1994 Egenolf ..... H01R 13/18 439/839
5,573,434 A 11/1996 Ittah
6,062,918 A 5/2000 Myer
6,872,103 B1 3/2005 Flieger
6,918,798 B2 7/2005 Patel
8,366,494 B2 2/2013 Nishide
(Continued)

FOREIGN PATENT DOCUMENTS

DE 102017113490 A 3/2016

*Primary Examiner* — Abdullah A Riyami
*Assistant Examiner* — Nelson R. Burgos-Guntin
(74) *Attorney, Agent, or Firm* — Andrew Wilford

(57) ABSTRACT

The invention relates to a contact element (1) for a plug connector, comprising a crimp region having crimp wings (5), with which same is connected to an electrical conductor of a line, wherein the contact element (1) has a spring-like contact geometry for a counter contact element in a contact region, wherein this contact geometry is provided in duplicate, characterised in that one part of the double contact geometry is formed by an additional contact element (3), wherein this additional contact element (3) is produced separately from the contact element (1) and, after production, same is arranged on the contact element (1) via a connection (4).

13 Claims, 11 Drawing Sheets

(56) References Cited

U.S. PATENT DOCUMENTS

| | | | | |
|---|---|---|---|---|
| 9,011,186 | B2 * | 4/2015 | Wirth | H01R 13/112 439/852 |
| 9,431,723 | B2 * | 8/2016 | Chikusa | H01R 13/113 |
| 9,831,586 | B2 | 11/2017 | Uezono | |
| 9,905,955 | B2 * | 2/2018 | Endo | H01R 13/424 |
| 10,122,108 | B2 * | 11/2018 | Bhagyanathan Sathianathan | H01R 13/432 |
| 2006/0166547 | A1 * | 7/2006 | Deutmarg | H01R 12/68 439/422 |
| 2007/0298648 | A1 * | 12/2007 | Fekonja | H01R 13/41 439/391 |
| 2010/0210154 | A1 * | 8/2010 | Boemmel | H01R 13/432 439/877 |
| 2014/0030934 | A1 * | 1/2014 | Wirth | H01R 13/18 439/816 |
| 2019/0363487 | A1 * | 11/2019 | Metzler | H01R 4/185 |

* cited by examiner

CONTACT FOR PLUG CONNECTOR

CROSS REFERENCE TO RELATED APPLICATIONS

This application is the US-national stage of PCT application PCT/EP2018/057155 filed 21 Mar. 2018 and claiming the priority of German patent application 102017106182.7 itself filed 22 Mar. 2017.

FIELD OF THE INVENTION

The invention relates to a contact for a plug connector, which contact comprises a crimp region that attaches the contact to an electrical conductor of a wire, the contact comprising two elastic contact formations for a mating contact in a contact region

BACKGROUND OF THE INVENTION

Such a contact is disclosed, for example, in published German patent application DE 10 2014 113 490. In the case of the embodiment of this patent application, the duplicate contact formation is formed by one single stamped-bent part. This certainly functions satisfactorily in principle, however there is the desire, in particular, for greater contact forces in the contact region to the mating plug connector that cannot be supported reliably by one stamped-bent part.

OBJECT OF THE INVENTION

The object of the invention is to improve the disclosed generic contact for a plug connector.

SUMMARY OF THE INVENTION

This object is in that the two contact formations in the contact region of the plug connector to the mating plug connector are retained. However, the one contact formation is realized by the contact itself, that is to say the stamped-bent part, the second contact formation being formed by a further contact that is on the contact. As a result, the advantage of the duplicate geometry, as described in DE 10 2014 113 490, can be retained. However, the force acting in the contact region can be adjusted, preferably increased, in a targeted manner as a result of the choice of the geometry (such as for example the thickness of the material) and of the material of the further contact that is to be mounted on the contact. The contact force can preferably be increased significantly as a result of fixing the additional contact and, for example, setting a different geometry or a greater material thickness or else also as a result of choosing a suitable material. A further advantage of the arrangement of an additional contact on the stamped-bent part, which itself forms the base contact, can be seen in that, by means of the contact, arbitrary geometries, which are not possible otherwise when producing the contact with the duplicate contact formation in the contact region as described in the prior art, can be realized for the additional contact not only in the case of a different material to the material of the stamped-bent part or to the material thickness thereof. As a result, the geometric freedom for realizing the contact according to the invention and, in particular, the increase in contact forces, is significantly boosted.

In a further development of the invention, the contact is realized in regions as a contact sleeve that receives the mating contact, wherein the contact sleeve comprises at least one projecting angled web on at least one longitudinal edge in the region of its abutting longitudinal edges. As a result of this design, the contact can be provided from a flat base material, reshaped and brought into its end form, which is a box form, into which the mating contact can be inserted. The production process is preferably a stamping and bending process. The at least one projecting angled web on at least one longitudinal edge is initially in the same plane as the side of the contact sleeve from which it projects. In order to close the box permanently and to avoid deformation, in particular when the mating contact is inserted, the projecting web is consequently not angled until the contact sleeve has been brought into its box form.

The at least one angled web that projects above the outer surface of the contact sleeve additionally serves for guiding the contact when it is inserted into a corresponding contact chamber of a contact holder. As a result of this at least one angled web, preferably multiple angled webs, the contact sleeve is guided precisely into its end position when it is inserted into the contact chamber of the contact holder.

In a further development of the invention, in the region of its abutting longitudinal edges, the contact sleeve, on the one longitudinal edge, comprises at least one web that engages in a corresponding recess in the other longitudinal edge. As a result of this tongue and groove design, the contact sleeve, after its reshaping from the flat element into the box form, is held in its form as well as or as an alternative to the at least one projecting angled web. Connecting the webs together permanently on the one longitudinal edge, which engages in a groove of the other longitudinal edge, via a weld point, for example carried out by laser welding, can be conceivable.

In a further development of the invention, an angled part is provided on an end of the contact sleeve that is remote from the crimp region. Contact polarization is effected as a result of this setback angled part, for example in the form of a tab that is at the end face of the contact.

In a further development of the invention, at least one end angled part is formed by the contact sleeve in a region of the contact sleeve to which the crimp region connects. As a result of this at least one end angled part, the contact can also be guided, but does not have to be, when it is inserted into the contact chamber of the contact holder. In addition to this or as an alternative to it, the at least one end angled part has the job of realizing a defined stop for the contact, the stop interacting with a locking latch of the contact holder. By means of this locking latch, the contact is fixed in its end position in the contact chamber of the contact holder. The actuation of the locking latch is not possible until the contact is inserted in its proper position in the contact holder. If this is not the case, the locking latch, which is preferably oriented and actuated transversely to the longitudinal shaping of the contact, is not actuated as its actuation is blocked either by the crimp tabs or the at least one end angled part.

In a further development of the invention, two end angled parts, which are aligned parallel to the longitudinal axis of the contact sleeve, are formed by the contact sleeve, wherein the ends of the two end angled parts stand out from the surface of the contact sleeve and are aligned at a spacing from one another. As a result of this end angled parts, which are designed symmetrically to the longitudinal axis of the contact sleeve, the production of the contact sleeve can be further simplified. Furthermore, it is possible to actuate the locking latch selectively from the one side or the other side proceeding from the contact chamber in the direction of the contact.

In a further development of the invention a contact spring is provided integrally with the contact sleeve proceeding from the contact sleeve pointing into its interior. This contact spring, together with the contact that is arranged as an additional element via the connection on the contact, in particular the contact sleeve, forms an increase in the normal force for the contact force when the mating contact is inserted into the interior of the contact sleeve. The contact, which is arranged via the connection on the contact sleeve, acts on the inserted mating contact together with this contact spring via a two-lever principle.

In a further development of the invention, the connection between the contact sleeve and the contact spring comprises a thickness reduction. Apart from the fact that the contact spring, which points into the interior of the contact sleeve, can be produced together with the contact sleeve itself, the advantage of the thickness reduction is that, as a result, the spring force or the spring characteristic curve of this additional contact spring can be set precisely. For example, the spring force or the alignment of this contact spring can be set such that it is ensured that this contact spring abuts at all times (that is to say without the mating contact inserted or with the mating contact inserted into the contact sleeve) against the contact that is on the contact sleeve by means of the connection. The advantage of the thickness reduction, furthermore, is that this abutting force can be adjusted in a targeted manner.

In a further development of the invention, the end of the contact spring abuts against a central region of the contact that is fastened via the connection. A plane-parallel abutment can consequently be realized in order to optimize the method of operation of the increase in normal force via the two-lever principle.

In a further development of the invention, the contact comprises a straight central region between the region in which it is fixed on the contact sleeve via the connection and its free end that points away from this. Here too, this results in a plane-parallel abutment of the contact against the free end of the contact spring for realizing the two-lever principle. This means that the geometry of the contact spring and of the contact are optimally matched to one another.

In a further development of the invention, the free end of the contact that is fixed on the contact via the connection, or of the contact sleeve thereof, comprises an end bend. This bend of the end of the contact prevents it from projecting outward from the contact sleeve into free space in such a manner that the contact is bent as a result of an external source. The bend of the free end consequently prevents unwanted deformation of the contact away from the contact sleeve such that this disadvantageous deformation is effectively avoided by the bend.

In a further development of the invention, at least one contact chamber support is formed by the contact sleeve in a region of the contact sleeve to which the crimp region connects. The achievement as a result of this contact chamber support is that the contact, after its production, is moved into a defined position when inserted into its associated contact chamber. The contact chamber support consequently produces a stop that comes to abut against a corresponding geometry of the contact chamber. If this occurs, the contact is situated in its proper position in the contact chamber. In this case, the contact chamber support interacts in an advantageous manner with the at least one end angled part in such a manner that the locking latch cannot be actuated until the contact chamber support has reached its required position in the contact chamber. In a further advantageous design, the contact chamber support is provided with a spring characteristic. As a result, the contact can advantageously be inserted into the contact chamber and fixed there in an automated manner. In order to realize a spring characteristic, the at least one contact chamber support is provided with a compression spring end geometry. Such a geometry can be realized, for example, by the contact chamber support being of an angled, arcuate, s-shaped or similar geometry in cross section.

In a further development of the invention, the end of the bend of the free end of the contact is aligned parallel to and at a spacing from the end of the end-face angled part of the contact sleeve. As a result, a defined gap is formed in this region that realizes protection against wire undercut and protection against over-extension in the direction of the contact sleeve. In particular, the spacing between the two end edges that face one another is chosen such that it is at least somewhat smaller than the outer diameter of the cable to which the contact is attached. This prevents, in an effective manner, the cable being able to penetrate into this front region of the contact when the cable is being stored, transported or handled with the contact already thereon.

In a further development of the invention, an outwardly projecting latching lug is formed by the contact sleeve. This latching lug acts together with a corresponding geometry in the contact chamber. As a result, the contact is primarily locked when it has been inserted into its contact chamber and has reached its proper end position. The locking latch, which consequently produces secondary locking of the contact on its contact holder, can be actuated in addition to this primary locking as already described.

In a further development of the invention, an indentation that points into the interior of the contact sleeve is provided between the region from which the latching lug projects from the contact sleeve and the end of the contact sleeve that is remote from the crimp region. This indentation, which can be produced, for example, using a thickness reduction method, realizes an extensive level inside the contact sleeve in order to avoid the formation of cracks on the underside of the contact domes that engages the contact with the inserted mating contact.

BRIEF DESCRIPTION OF THE DRAWING

Different views of an embodiment are shown in the drawing in which.

SPECIFIC DESCRIPTION OF THE INVENTION

Figure 1:
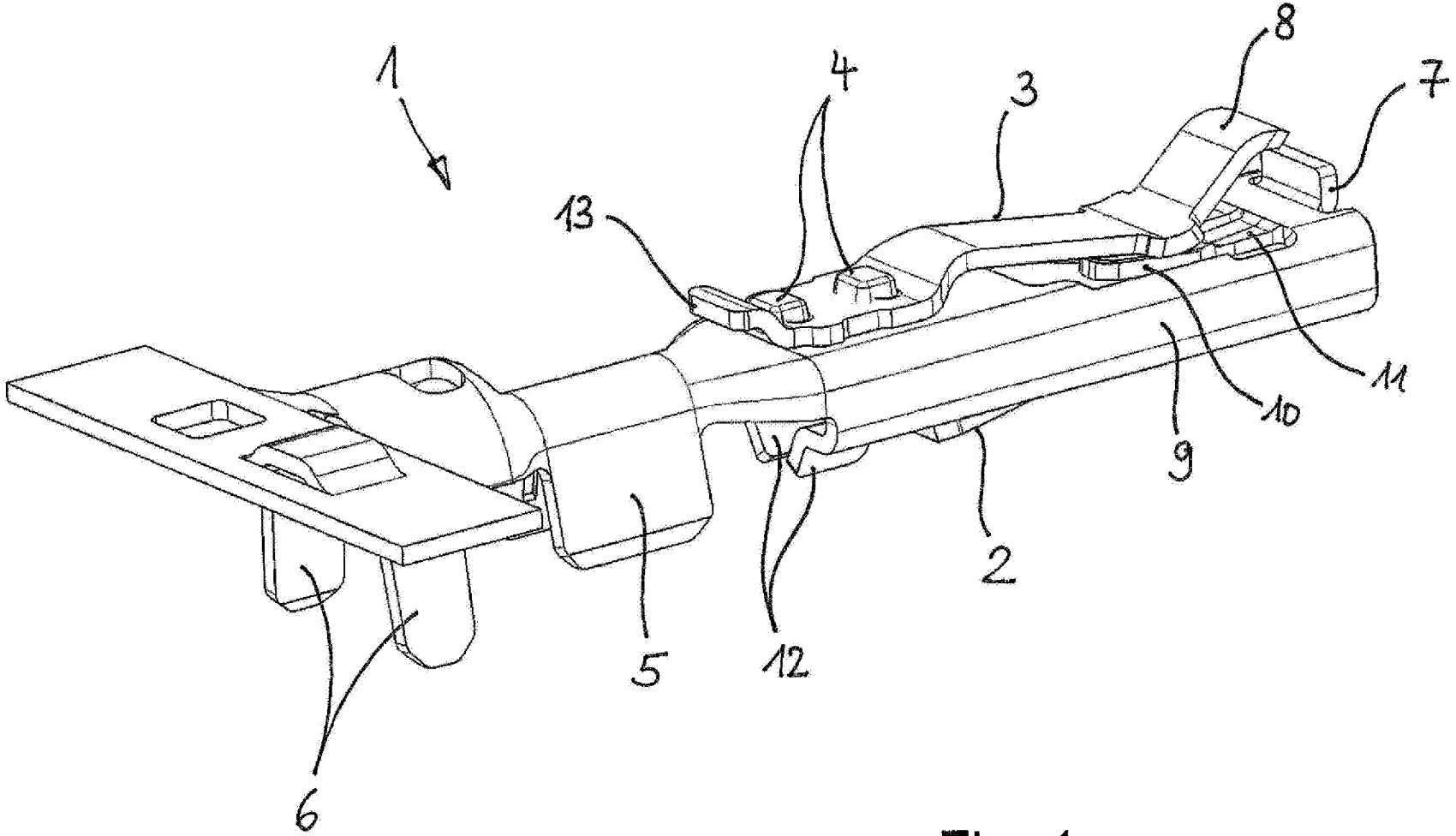
FIGS. 1 to 9 show a first embodiment of the invention.

FIG. 1 shows a contact 1 that comprises a latching lug 2 for the purpose of the primary locking of the contact 1 in an unillustrated contact chamber of a contact holder. In addition, according to the invention, there is an additional contact 3 that is secured by a connection 4 on the contact 1, which is realized in an integral manner per se. As is known, the contact 1 has crimp tabs 5 in order to connect an electrical conductor of a cable mechanically and electrically to the contact 1. In addition, there are two tabs of a strain relief 6. These two tabs can also be bent around like the crimp tabs 5 and fit snugly to the outer surface of the outer casing of the wire. Where applicable, a single conductor seal, which interacts with the contact chamber of the contact holder for the purpose of sealing against rainwater, can be on the outer casing of the cable.

At the front end, that is to say on the end of the contact 1 remote from the crimp region, there is an angled part 7.

This angled part 7 lies at the front end in the same plane as the end-face end of the contact 1.

The additionally mounted contact 3 comprises a bent part 8 at its free end. In addition, the contact 1 comprises a contact sleeve 9. A contact spring 10, which interacts with the contact 3, extends from the contact sleeve 9. The contact spring 10 can have, but does not have to have, a thickness reduction 11 in the transition region from the contact sleeve 9 to the free region. In addition, the contact sleeve 9 forms an end angled part 12 formed with two projecting tabs that spaced along the longitudinal axis of the contact 1. In addition, there is a contact chamber support 13. This contact chamber support 13 is formed in this embodiment by the additionally attached contact 3. As an alternative to this or in addition to it, such a contact chamber support 13 can also be formed by the contact sleeve 9.

Figure 2:
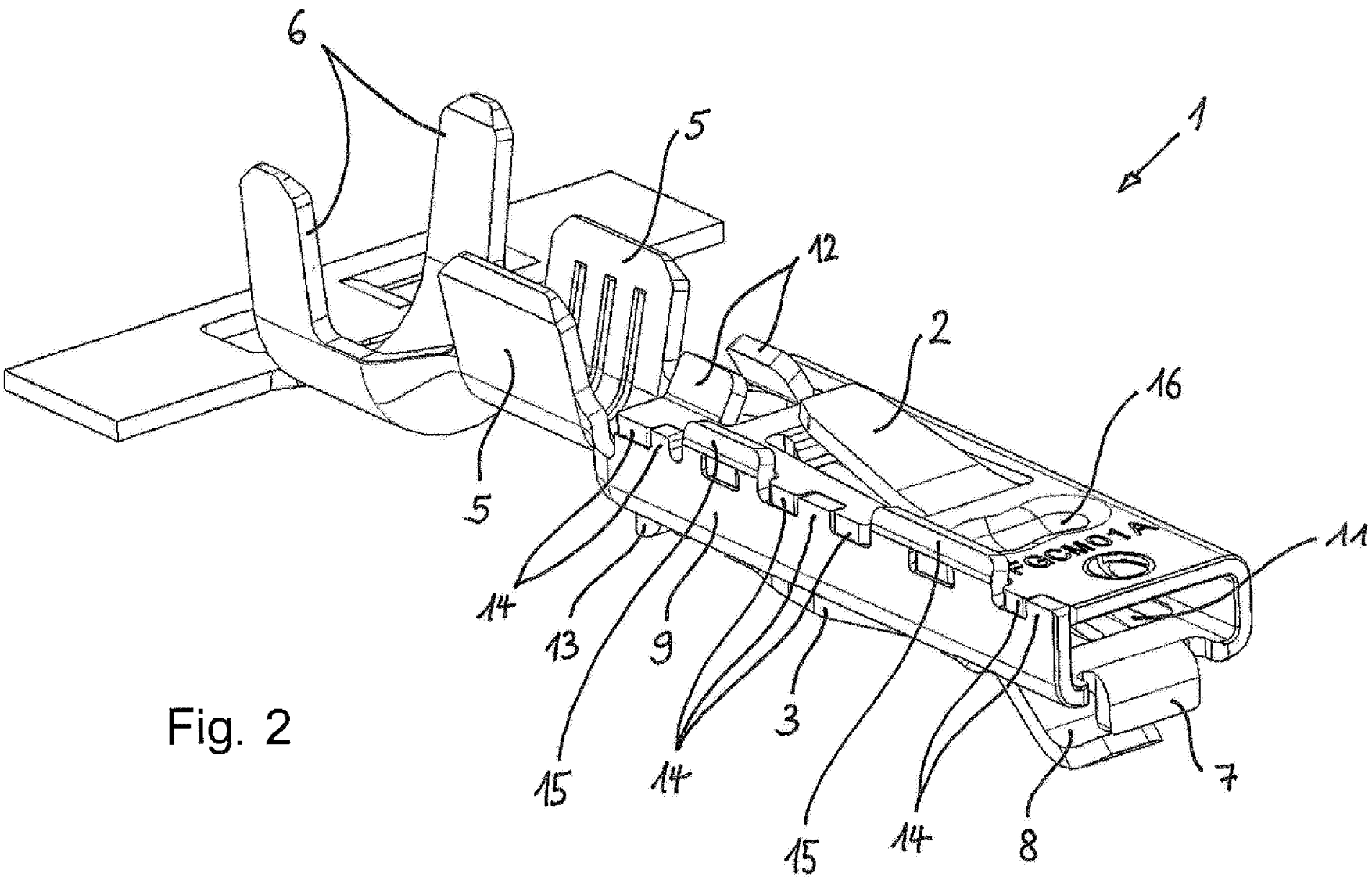

FIG. 2 shows the same contact 1. The cross section of the contact sleeve 9 can be seen here and has been brought into the form shown by bending a flat element. FIG. 2 shows two possibilities for connecting the abutting longitudinal edges of the contact sleeve 9 together that can be realized together, or each case can be seen on its own merits. On the one hand, tabs 14, which face one another and that form a type of tongue and groove system and come to abut against one another when the contact sleeve 9 has been brought into the positions shown in FIG. 2, are provided on the two longitudinal edges. If these webs 14 abut, a weld operation can be carried out as an option in this region, for example a weld point can be made to join the two webs 14 that face one another. In addition, at least one angled part 15 (in the embodiment two angled parts 15 spaced apart) is provided. Each angled part 15 is initially in the same plane as the side face of the contact sleeve 9, from which it projects. Not until the contact sleeve 9 is brought into its form shown is the deformation thereof effected as a result of the introduction of force onto the angled part 15 in order, consequently, to close the contact sleeve 9. An angled part within the range of between 10 and 20°, preferably 15°, has proved to be optimum in order to ensure permanent closure and in order to avoid unnecessary high forces for the angled part.

In addition, FIG. 2 shows an indentation 16 that is between the latching lug 2 and the end of the contact 1.

Figure 3:
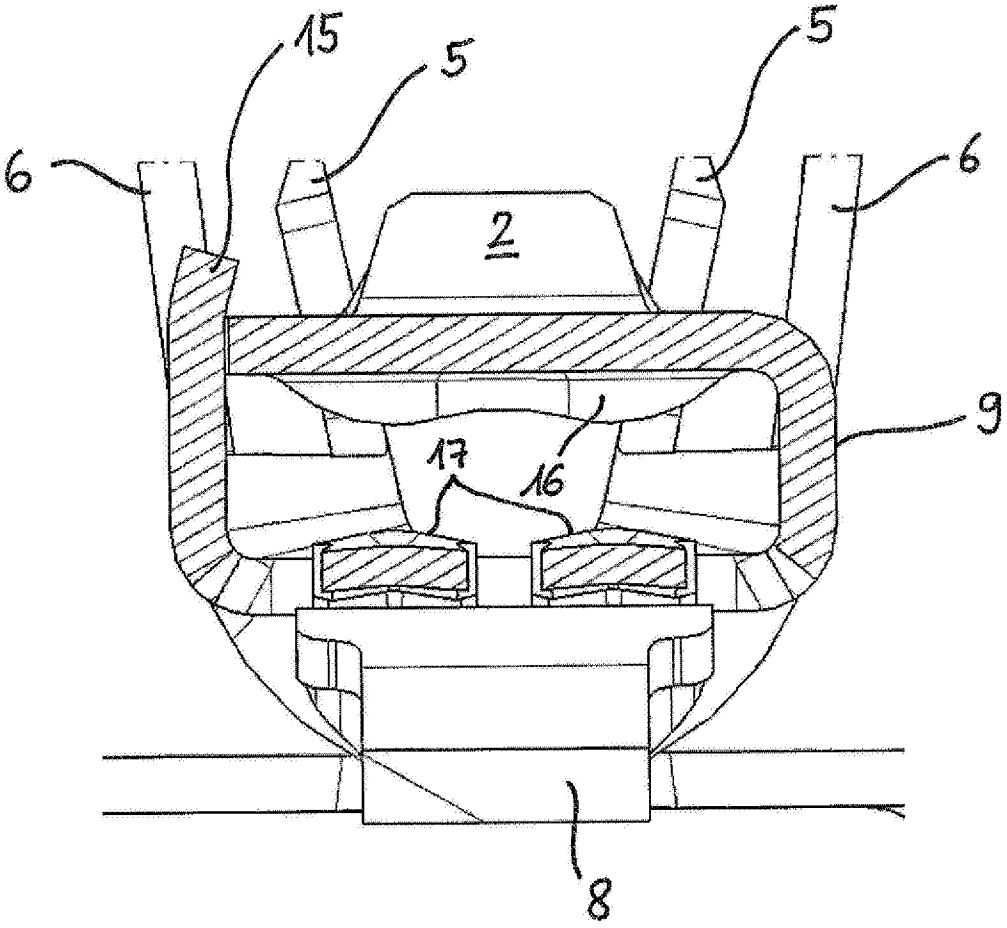

FIG. 3 shows the contact 1 sectioned at the contact sleeve 9. On the one hand, the indentation 16 can be seen. On the other hand, at least one contact point, here two contact points 17, are formed by the contact sleeve 9 or as an alternative to this is thereon. These contact points 17 formed for example like a contact spring, are convex to increase stability. That is to say that they have an arched form, as can be seen in FIG. 3. In addition, it is also conceivable to provide these contact points 17 with a coating. They form an electrical contact point for electrically contacting the contact 1 with a mating contact inserted into the contact sleeve 9.

Figure 4:
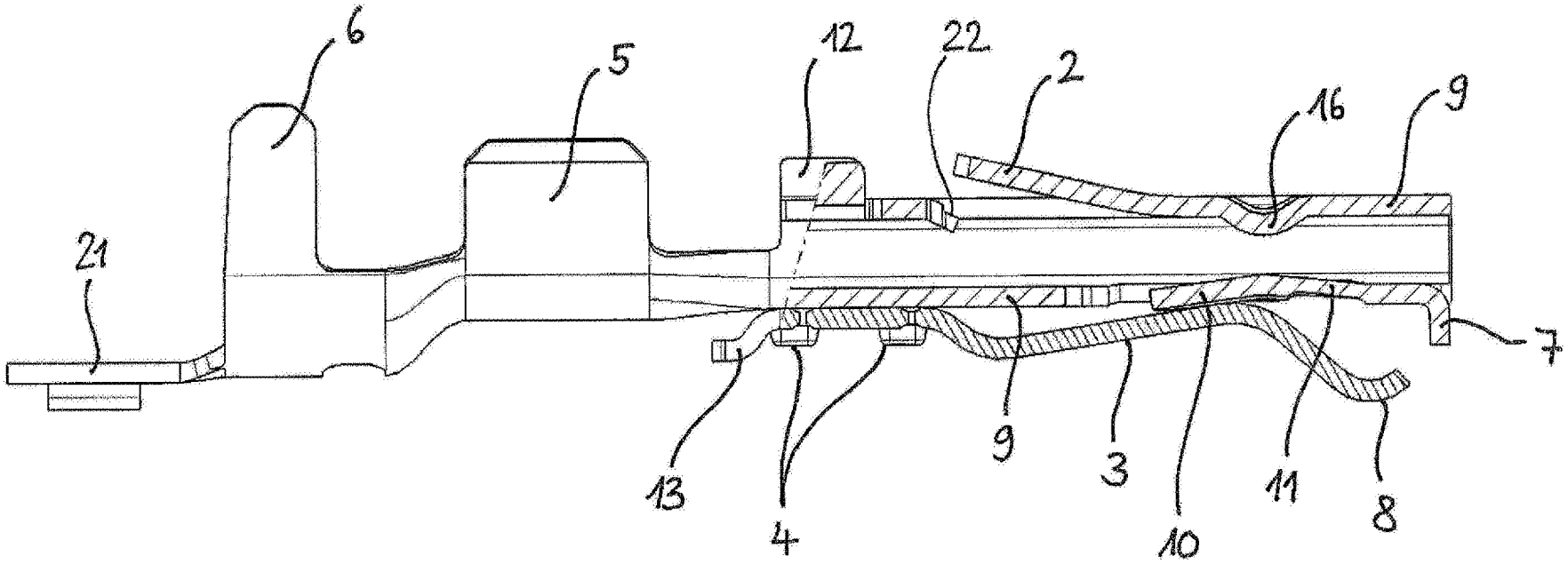

FIG. 4 shows the contact also in a section through the contact sleeve 9. In this connection, the shape of the contact chamber support 13 in particular can be seen, through which a compression spring end geometry is realized. In addition, it can be seen that the free end of the contact spring 10 abuts against a central region, in particular in a straight central region, of the contact 3 in order, as a result, to realize the increase in the normal force via the two-lever principle. Both a part of the inwardly pointing contact spring 10 and the indentation 16 and the at least one contact point 17 (not shown) form the contacting regions for the mating contact. In addition, it can also be seen that the end of the bend 8 of the free end of the contact 3 is aligned parallel to and at a spacing from the end of the angled part 7 in order to protect against wire undercut and protection against over-extension in the direction of the contact sleeve. If in fact an inadmissibly high force is exerted onto the contact 3, in particular onto its bent-in free end 8, this contact 3 cannot be moved fully inward into the contact sleeve 9 (even under inadmissible deformation of the contact spring 10) as the end of the bend 8 comes to abut on the right against the edge of the angled part 7.

Figure 6:
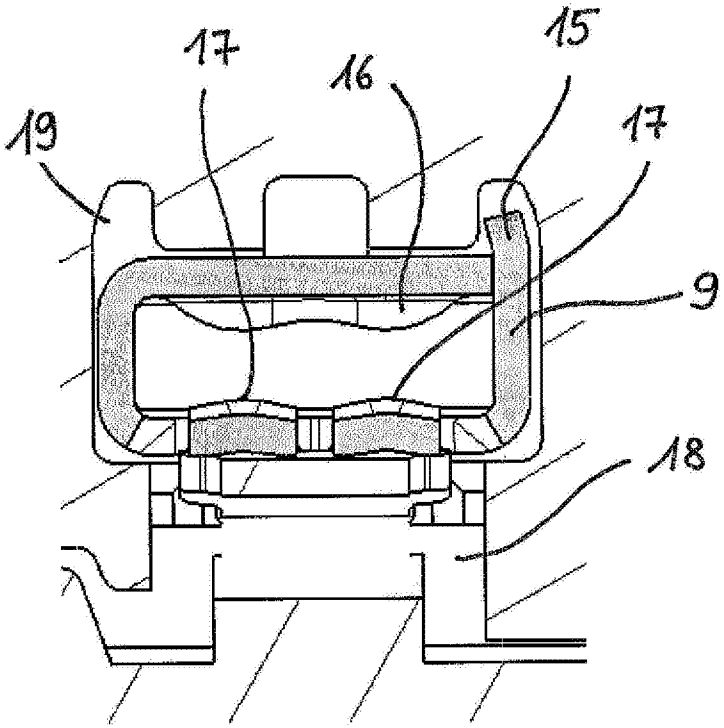
Figure 5:
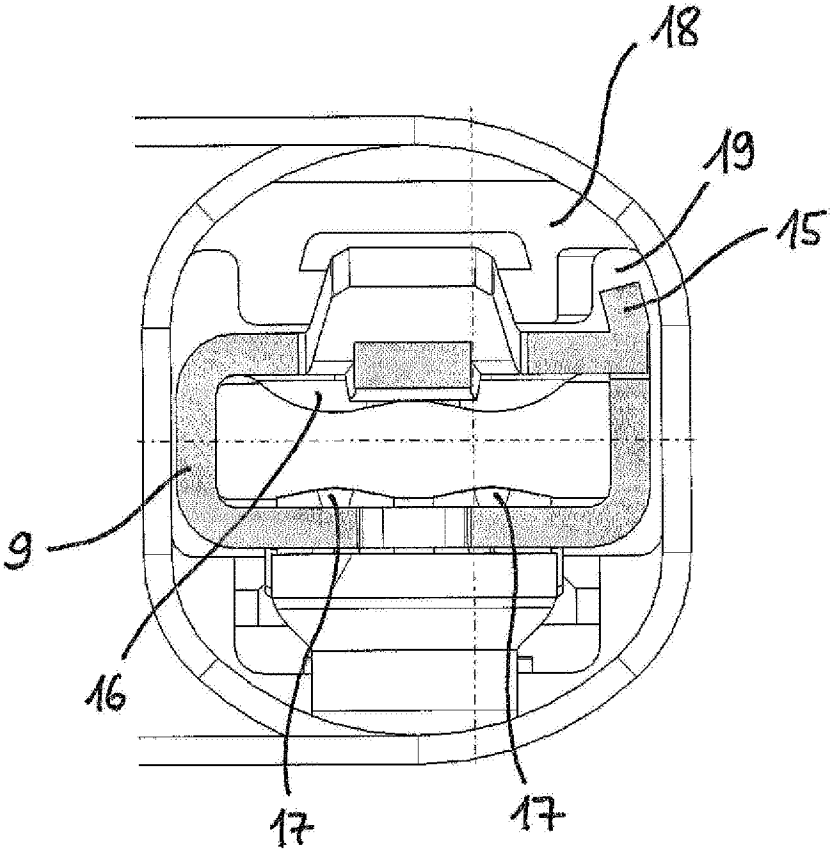

FIGS. 5 and 6 show the contact 1 inserted into contact chamber 19 of a contact holder 18. In this case, FIG. 5 shows the contact chamber 19 from the direction of the crimp region of the contact 1, whereas FIG. 6 shows the view of the contact chamber 9 from the front, that is to say from the direction of the connector face of the contact 1.

Figure 8:
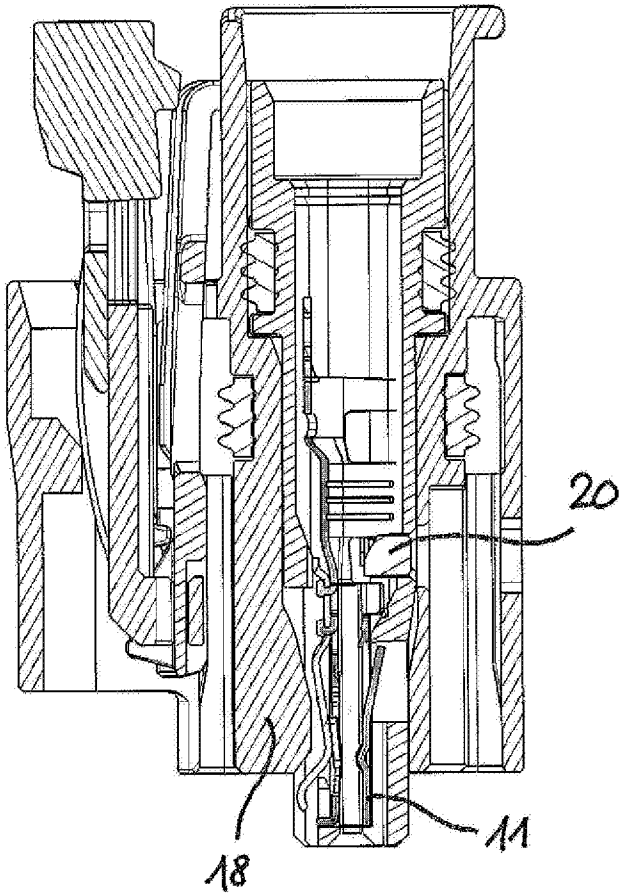
Figure 7:
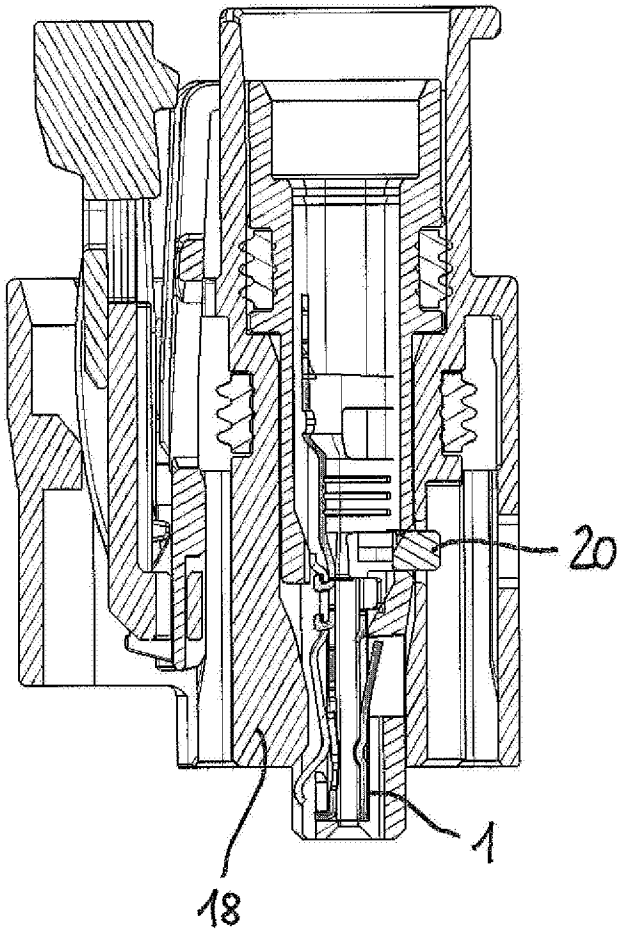

FIGS. 7 and 8 show a finished plug connector that comprises the contact holder 18 with the inserted contact 1. Additionally present, but not designated in any more detail, are seals between the contact holder and a housing, in which the contact holder is inserted. In addition, the plug connector can comprise an additional locking device (so-called CPA) but does not have to.

When looking at FIGS. 7 and 8, the essential point is the presence and the actuation of a locking latch 20. This locking latch 20 interacts with the contact holder 18. In FIG. 7, the locking latch 20 is shown in its open position. This means that, once its production is complete, the contact 1 can be inserted into the contact chamber 19. The locking latch 20 can only be actuated if this contact abuts there in the correct manner, that is to say if the contact chamber support 13 has also reached its required position. After its actuation, it locks the contact 1 in the contact chamber 19 in cooperation with the at least one end angled part 12. In this embodiment, the contact 1 is constructed in such a manner that the locking latch 20 is able to slide precisely into a free region between the end angled part 12 and the crimp tabs 5 when the contact 1 has been oriented properly and in its correct position in the contact chamber 19.

Figure 9:
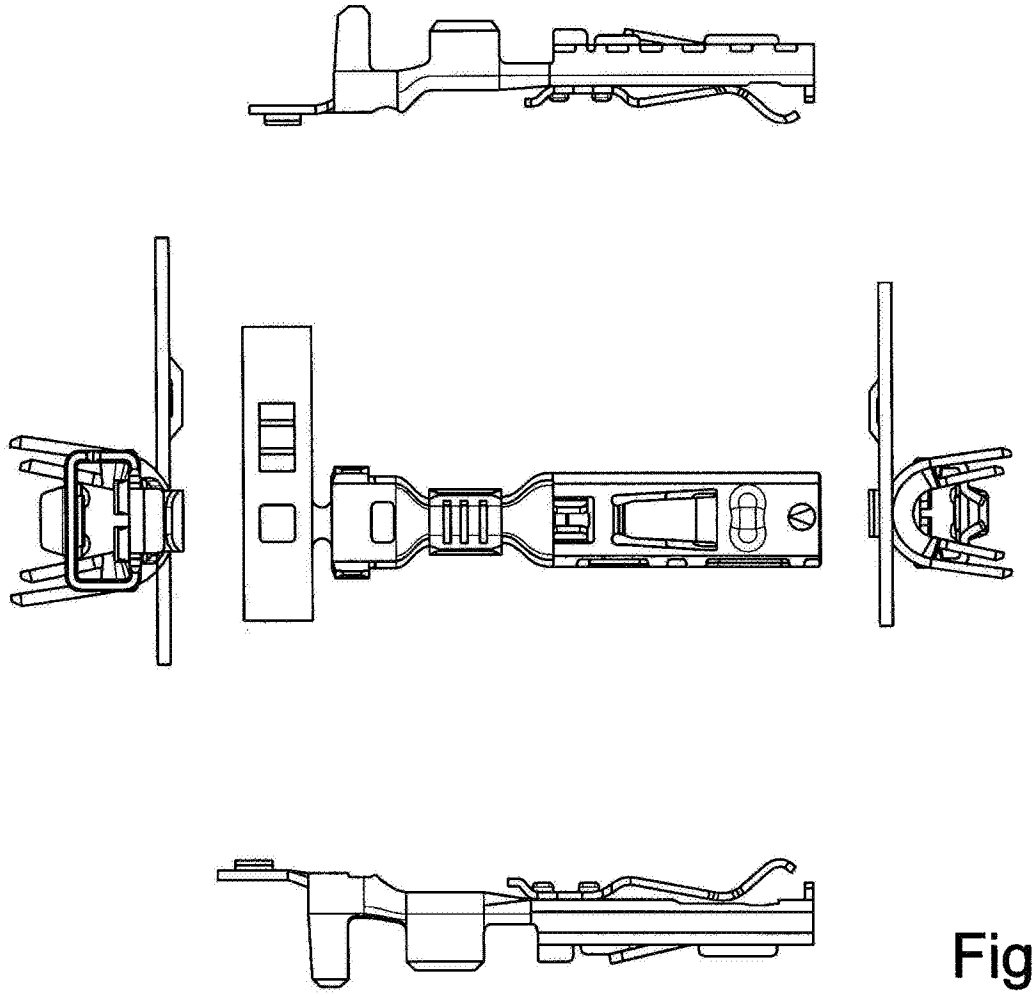
Figure 11:
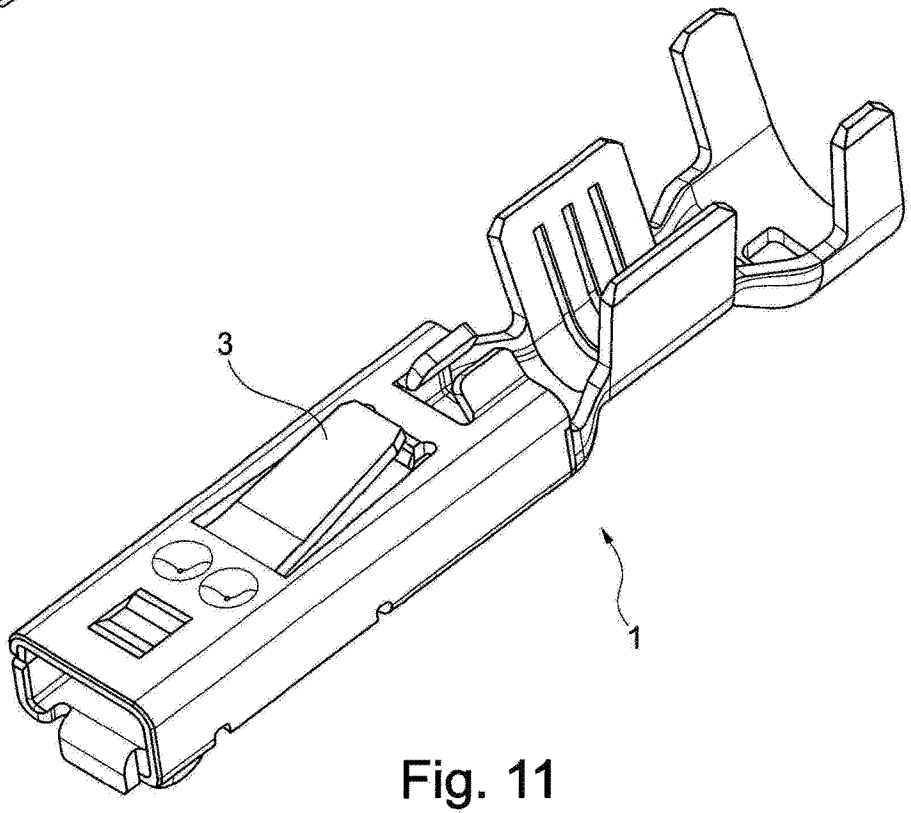
FIGS. 10 to 17 show a second embodiment.
Figure 10:
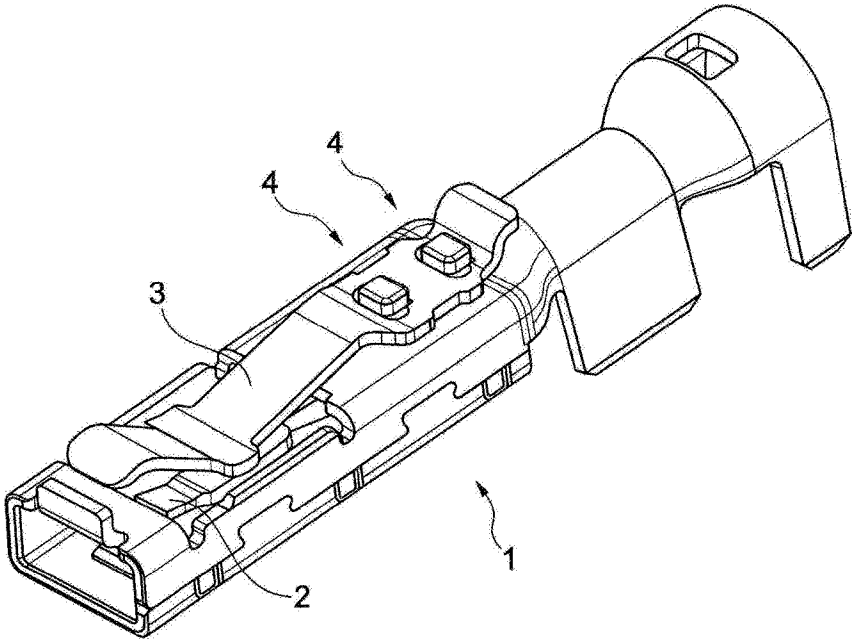
Figure 12:
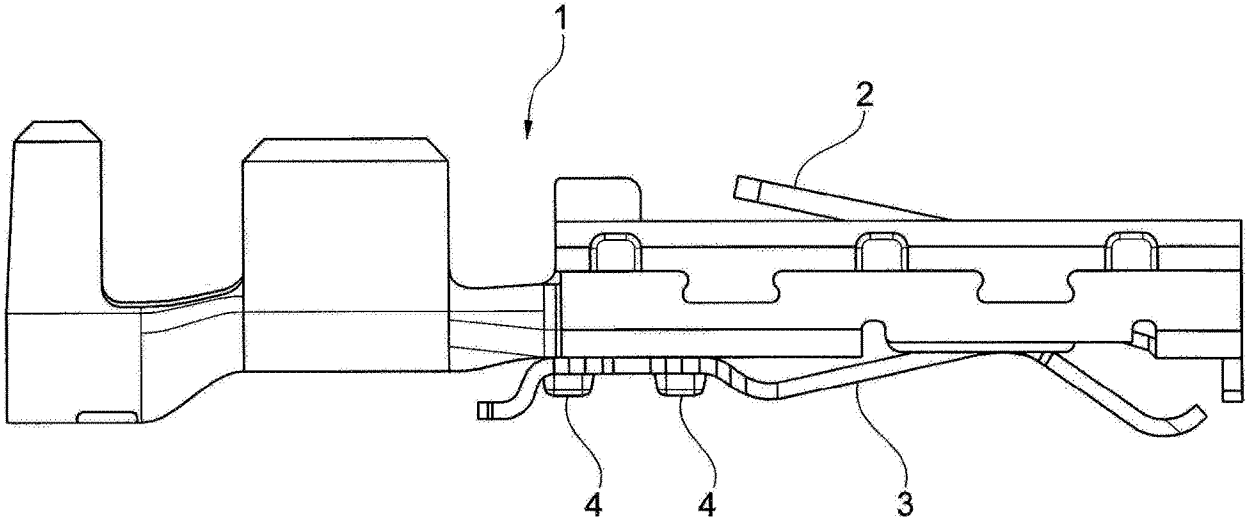
Figure 13:
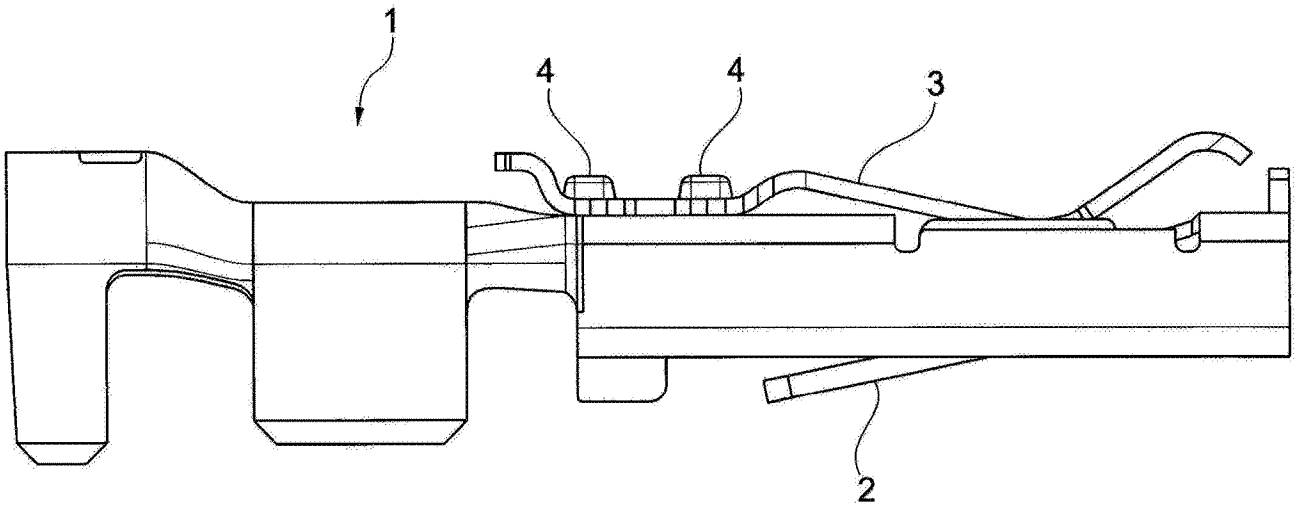
Figure 14:
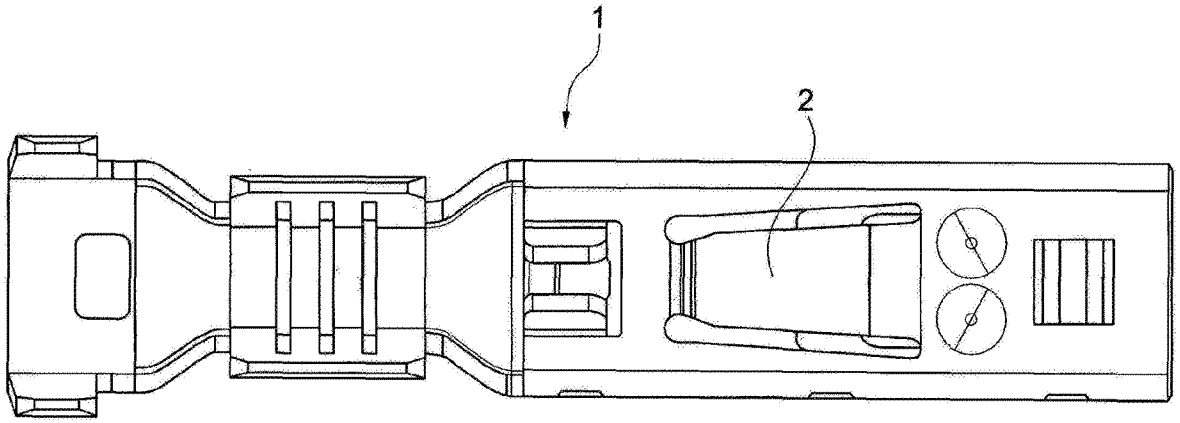
Figure 15:
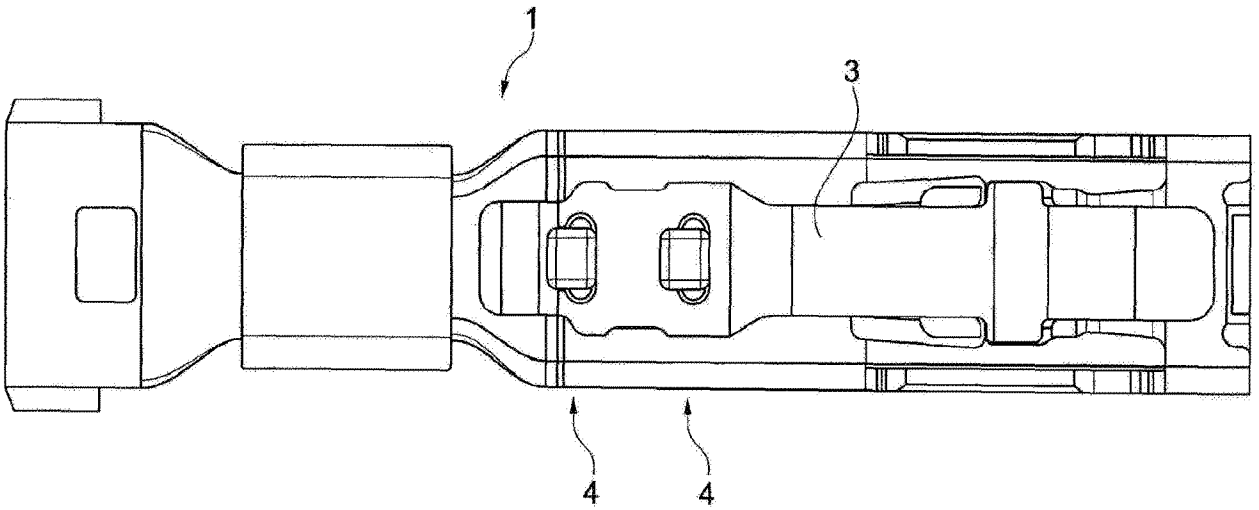
Figure 17:
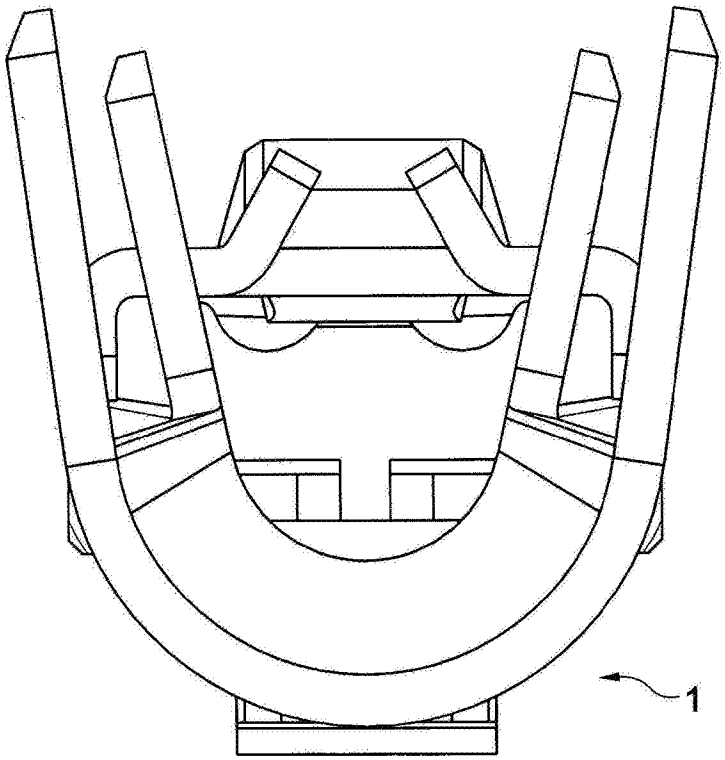
Figure 16:
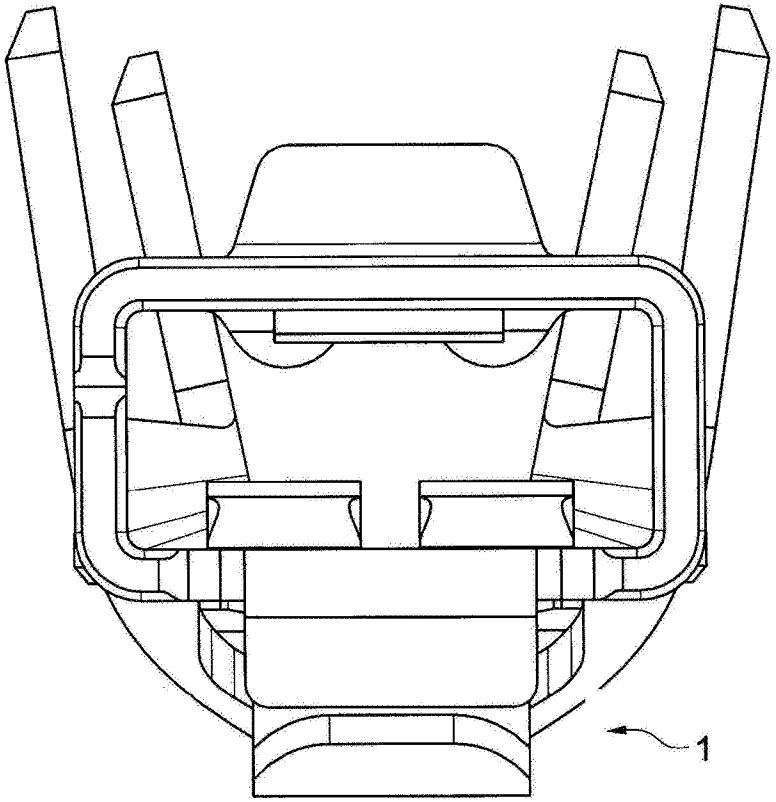

The various views of the contact according to the invention already described above are shown one more time in FIG. 9.

With reference to FIG. 4, it must still be pointed out that the contact 1 is shown in the drawing with a projection 21. This projection 21 is necessary for handling the contact 1 during its production in a stamping and bending process. Once the production has been completed and the contact 1 has been brought into its definitive form shown in the figures, the projection 21 is removed. In addition, reference is made to an angled part 22 that is also formed by the contact sleeve 9 (for example by a stamping) but could also be a separate part that is produced independently of the contact sleeve 9 and is subsequently fastened thereon. This element of the angled part 22, which can also be designated as a projection, projects somewhat into the interior of the contact sleeve 9. Its job is to protect the latching lug 2 against over-extension in order to prevent the latching lug 2 being pressed into the interior of the contact sleeve 9 if an external force acts on this latching lug in the direction of the contact sleeve 9.

Both in general and for the embodiment described above as well as for the embodiment still to be described below, the one contact formation is realized by the contact 1 itself, that is to say the stamped-bent part thereof (as a result of direct abutment of the mating contact against the contact 1, the contact sleeve 9 thereof, the contact spring 10 thereof, the indentation 16 thereof and/or the at least one contact point 17 thereof), the second contact formation being formed at least by the further contact 3 that is on the contact 1, in particular on the contact sleeve 9 thereof. This further contact 3 then abuts directly against the mating contact when this mating contact is inserted into the contact sleeve 9, and consequently produces the electrical connection, or it abuts indirectly against the mating contact when this mating contact is inserted into the contact sleeve 9, for example via the contact spring 10, such that the contact 3 acts with a required force on the mating contact via the contact spring 10 and, as a result, not only is the contact formation formed but the electrical connection between the contact 1 and the inserted mating contact is also produced.

A further embodiment is shown in FIGS. 10 to 17. The design of the contact 1 shown is substantially similar to the contact that is disclosed in DE 10 2014 113 490.

The duplicate contact formation is also present but both contact regions that form the duplicate contact formations can be designed identically but do not have to be.

In the case of the illustrated contact 1, a contact 2 formed from the stamped-bent part that forms the contact 1 is provided for forming the one contact region. A further contact 3 is produced independently of the stamped-bent part preferably also in a stamping and bending process and is on the basic body of the contact 1. Mounting of the additional contact 3 on the base contact 1 is preferably effected by a connection 4, which can be a rivet or a connection by caulking.

The invention claimed is:

1. A contact assembly for a plug connector, the contact assembly comprising:

a longitudinally open contact sleeve that receives a mating contact;

a crimp region offset longitudinally from the contact sleeve and having crimp tabs that attach the contact assembly to an electrical conductor of a wire;

two elastic contact formations for mating contact at a contact region with a counter contact region, one of the two contact formations being formed by an additional contact that is produced separately from the contact assembly and after production is mounted on the contact assembly via a connection, the additional contact having a free end longitudinally opposite the crimp region and formed with an outward end bend; and an angled part formed at an end of the contact sleeve remote from the crimp region and protecting the free end of the additional contact from being engaged longitudinally and bent.

2. The contact assembly according to claim 1, wherein the contact sleeve has at least one projecting angled web on at least one longitudinal edge in the region of its abutting longitudinal edges.

3. The contact assembly according to claim 1, wherein in the region of its abutting longitudinal edges the contact sleeve, on one of the longitudinal edges has at least one web that engages in a corresponding recess in the other longitudinal edge.

4. The contact assembly according to claim 1, wherein the at least one end angled part is formed by the contact sleeve in a region of the contact sleeve to which the crimp region connects.

5. The contact assembly according to claim 4, wherein two such end angled parts aligned parallel to the longitudinal axis of the contact sleeve are formed by the contact sleeve, the ends of the two end angled parts standing out from the surface of contact sleeve and being aligned at a spacing from one another.

6. The contact assembly according to claim 1, further comprising:

a contact spring provided integrally with the contact sleeve extending from the contact sleeve pointing into its interior.

7. The contact assembly according to claim 6, wherein the connection between the contact sleeve and the contact spring has a thickness reduction.

8. The contact assembly according to claim 6, wherein the end of the contact spring abuts against a central region of the additional contact.

9. The contact assembly according to claim 1, wherein the additional contact has a straight central region between the region in which it is fixed to the contact sleeve via the connection and its free end that points away from it.

10. The contact assembly according to claim 1, wherein at least one contact chamber support is formed by the contact sleeve in a region of the contact sleeve to which the crimp region connects.

11. The contact assembly according to claim 1, wherein the end of the bend of the free end of the additional contact is aligned parallel to and at a spacing from the end of the angled part.

12. The contact assembly according to claim 1, wherein an outwardly projecting latching lug is formed by the contact sleeve.

13. The contact assembly according to claim 12, wherein an indentation pointing into the interior of the contact sleeve is provided between the region from which the latching lug projects from the contact sleeve and the end of the contact sleeve that is remote from the crimp region.

* * * * *